United States Patent [19]

Lee

[11] 4,128,957

[45] Dec. 12, 1978

[54] REVOLVER-TYPE HAND GUN

[75] Inventor: Joseph L. Lee, Woodbridge, Conn.

[73] Assignee: Stephen Andrew Lee, Woodbridge, Conn.

[21] Appl. No.: 757,212

[22] Filed: Jan. 6, 1977

[51] Int. Cl.[2] ..... F41C 1/00

[52] U.S. Cl. ..... 42/65; 42/66; 42/71 P

[58] Field of Search ..... 42/65, 66, 59, 71 P

[56] References Cited

U.S. PATENT DOCUMENTS

| | | | |
|---|---|---|---|
| D. 18,966 | 3/1889 | Davis | 42/71 P |
| 658,314 | 9/1900 | Bye | 42/66 |
| 961,188 | 6/1910 | Wesson | 42/66 |
| 1,898,368 | 2/1933 | Hęss et al. | 43/71 P |
| 3,128,571 | 4/1964 | Herrett | 42/71 P |
| 3,158,949 | 12/1964 | Freed | 42/65 |
| 3,176,423 | 4/1965 | Geber | 42/65 |
| 3,245,167 | 4/1966 | Freed | 42/65 |
| 3,367,053 | 2/1968 | Lewis | 42/71 P |
| 3,654,720 | 4/1972 | Ruger | 42/65 |
| 3,903,630 | 9/1975 | Dirstine | 42/65 |

FOREIGN PATENT DOCUMENTS

| | | | |
|---|---|---|---|
| 73402 | 10/1916 | Switzerland | 42/71 P |

*Primary Examiner*—Charles T. Jordan
*Attorney, Agent, or Firm*—Edward R. Weingram

[57] ABSTRACT

A double-action revolver has a hammer assembly which includes a mechanism for positively defining the displacement and the engagement positions of the sear to insure accurate and smooth coaction of the sear with the trigger mechanism.

The trigger assembly includes a cylinder-actuating hand, trigger lever, and transfer slide which is raised by the trigger to a position where it is struck by the hammer to percuss the firing pin. Percussing of the firing pin can only be accomplished by coaction of the trigger and hammer, thereby eliminating the requirement for a hammer block or other safety device.

The handle of the revolver includes a wedge-shaped section adapted to fit snugly in the web of the palm between the thumb and first finger, while the butt of the handle fits in the hypothenar eminence area of the palm, so that the handle will be stably held at both its upper and lower ends during the firing cycle of the revolver, to prevent bucking or twisting of the revolver when it is discharged.

14 Claims, 9 Drawing Figures

REVOLVER-TYPE HAND GUN

BACKGROUND OF THE INVENTION

1. Field of the Invention

This invention relates to revolver-type hand guns and, more specifically, to the revolvers having improved trigger, hammer and handle construction and the coaction thereof.

2. Description of the Prior Art

Double-action revolvers require elaborate and precise coaction between the trigger and the hammer in order for the operator of the revolver to be able to easily and smoothly discharge the revolver without disturbing the position of the weapon and thereby reducing the accuracy of the shot. The trigger force necessary to actuate the firing mechanism must be as smooth and uniform as possible. One of the most critical areas of coaction is between the trigger and the sear of the hammer. The engagement and disengagement of the sear with the trigger during the firing cycle effects the smoothness of the trigger pull and the amount of force that is necessary to pull the trigger.

In the past, great efforts have been made to position the sear as accurately as possible with respect to the trigger, in order to increase the smoothness of operation, while at the same time attempting to avoid placing the sear so close to the trigger so as to interfere with the smooth displacement of the trigger. Because of the relationship of the sear to the trigger, it is common to grind the point of contact between the sear and the hammer, to which it is attached, and also, on some occasions to grind the end of the sear that contacts the trigger in order to provide the degree of smoothness and uniformity required for proper operation of the firearm. This hand grinding requirement has several disadvantages. Not only is the machining of the parts much more costly, but in addition, each firearm becomes, to some extent, a one-of-a-kind item, with custom made mating parts which cannot be easily replaced without custom machining.

Another problem that has long existed in connection with the design of revolver-type hand guns is the necessity to provide an effective safety mechanism which can prevent the accidental discharge of the weapon if it is dropped, or if the hammer should somehow slip from the cocked position without being actuated by the trigger. Methods of providing blocking members or hammer blocks, which are interposed between the hammer and the firing pin and actuated by the trigger have effectively served this function, but they often require additional mechanisms to be placed in the chain of coacting parts that are involved in firing the weapon, which adds to the complexity of the mechanism and complicates the sequence of forces that must be overcome by the trigger pull. Additionally, some hammer block devices can become inoperative without being apparent to the user of the weapon, so that corrective action will not be taken in a prompt and expeditious manner suitable to the seriousness of the failure of this important safety device.

Another problem that has existed in the manufacture of revolver-type hand guns relates to the stability of the hand gun in the grip of the user when the weapon is discharged. Revolver design has traditionally followed that of the "Wild West" six-shooter type hand gun, in which the front and back surfaces of the handle resembled arcs of non-concentric circles, with the handle tapering from the widest point at the butt or bottom surface, to the narrowest point near the top of the handle. This design may have had advantages for the users of the hand gun during past times, such as providing a surface suitable for quick grabbing during a fast draw. However, this traditional design makes the weapon inherently unstable in the hand of the user, seriously reducing the accuracy and usefulness of the weapon for other uses. During the discharge of the weapon, the barrel has a tendency to rise. However, because the handle is held primarily at its widest point, which is at the bottom or butt, and it is not adequately supported at the top where it is narrowest, the twisting force of the rising barrel will cause the weapon to twist in the user's hand, so that the weapon has to be regripped and reaimed for the next shot to be taken.

SUMMARY OF THE INVENTION

In order to overcome the problems in the prior art discussed above, the present invention sets forth a double-action revolver having a hammer assembly which includes mechanism for positively defining the displacement and the engagement positions of the sear to insure accurate and smooth coaction of the sear with the trigger mechanism.

The trigger assembly includes a cylinder-actuating hand, trigger lever, and transfer slide which is raised by the trigger to a position where it is struck by the hammer to percuss the firing pin. Percussing of the firing pin can only be accomplished by coaction of the trigger and hammer, thereby eliminating the requirement for a hammer block or other safety device.

The handle of the revolver includes a wedge-shaped section adapted to fit snugly in the web of the palm between the thumb and first finger, while the butt of the handle fits in the hypothenar eminence area of the palm, so that the handle will be stably held at both its upper and lower ends during the firing cycle of the revolver, to prevent bucking or twisting of the revolver when it is discharged.

Accordingly, in view of the above, it is an object of the present invention to provide a revolver-type hand gun which provides a more accurately fabricated and smoothly working firing mechanism.

Another object of the present invention is to provide a revolver-type hand gun which provides a sear construction which does not require grinding or custom fitting to define the position or travel or coaction of the sear.

It is still another object of the present invention to provide a revolver-type hand gun which provides a sear construction more precisely dimensioning the movement of the sear and connection of the sear with the trigger.

Yet another object of the present invention is to provide a revolver-type hand gun which has a simplified sear construction process.

It is a further object of the present invention to provide a revolver-type hand gun which provides greater accuracy because of smoother trigger action.

An additional object of the present invention is to provide a revolver-type hand gun which eliminates the need for a rebound slide to position the trigger and provide for uniform trigger pressure.

It is another object of the present invention to provide a revolver-type hand gun having a simplified trigger assembly construction.

till another object of the present invention is to vide a revolver-type hand gun which provides im- ved safety features.

t is yet another object of the present invention to vide a revolver-type hand gun which does not re- re a hammer block to prevent accidental discharge.

further object of the present invention is to provide evolver-type hand gun which provides a transfer e that is struck by the hammer to in turn percuss the ig pin, to thereby prevent accidental discharge of hand gun.

t is an additional object of the present invention to vide a revolver-type hand gun which provides a isfer slide which is held in operative position by the t of the hand gun.

nother object of the present invention is to provide evolver-type hand gun having a transfer slide firing actuator controlled by movement of the trigger icidentally with movement of the hand to rotate the nder of the hand gun.

t is still another object of the present invention to vide a revolver-type hand gun having a trigger as- bly in which a single pin controls the transfer slide d for percussing the firing pin and the hand used for ting the cartridge cylinder.

et another object of the present invention is to pro- e a revolver-type hand gun having increased stabil- in the hand of the user during the discharge of the d gun.

t is a further object of the present invention to pro- e a revolver-type hand gun having a handle which reduce the tendency of the hand gun to pivot or st in the hand of the user when discharged.

n additional object of the present invention is to vide a revolver-type hand gun having a wedge- ped handle to provide increased control contact ween the palm of the user's hand and the handle of firearm.

t is another object of the present invention to pro- e a revolver-type hand gun which is of relatively plified construction, relatively durable construction, relatively greater reliability and relatively greater uracy.

ther objects and advantages will be apparent from following description of the preferred embodiment he invention, and the novel features will be particu- y pointed out hereinafter in connection with the ended claims.

RIEF DESCRIPTION OF THE DRAWINGS

IG. 1 is a left side view of the hand gun built in ordance with the teachings of the present invention, wing it as it would be gripped in the hand of a user.

IG. 2 is a top view of the hand gun shown in FIG. howing it as it would be gripped in the hand of a r.

IG. 3 is a right side view, partially broken away, wing a hand gun built in accordance with the pres- invention, in the rest position.

IG. 4 is a view of the hand gun of FIG. 3, with the ger and hammer in the drawn-back or cocked posi- .

IG. 5 is a view of the hand gun as shown in FIGS. d 4, with the trigger drawn all the way back and the mer and associated mechanism in the striking posi- for firing the hand gun.

IG. 6 is a view taken along lines 6—6 of FIG. 4.

IG. 7 is a view taken along lines 7—7 of FIG. 5.

DESCRIPTION OF THE PREFERRED EMBODIMENT

Figure 1:
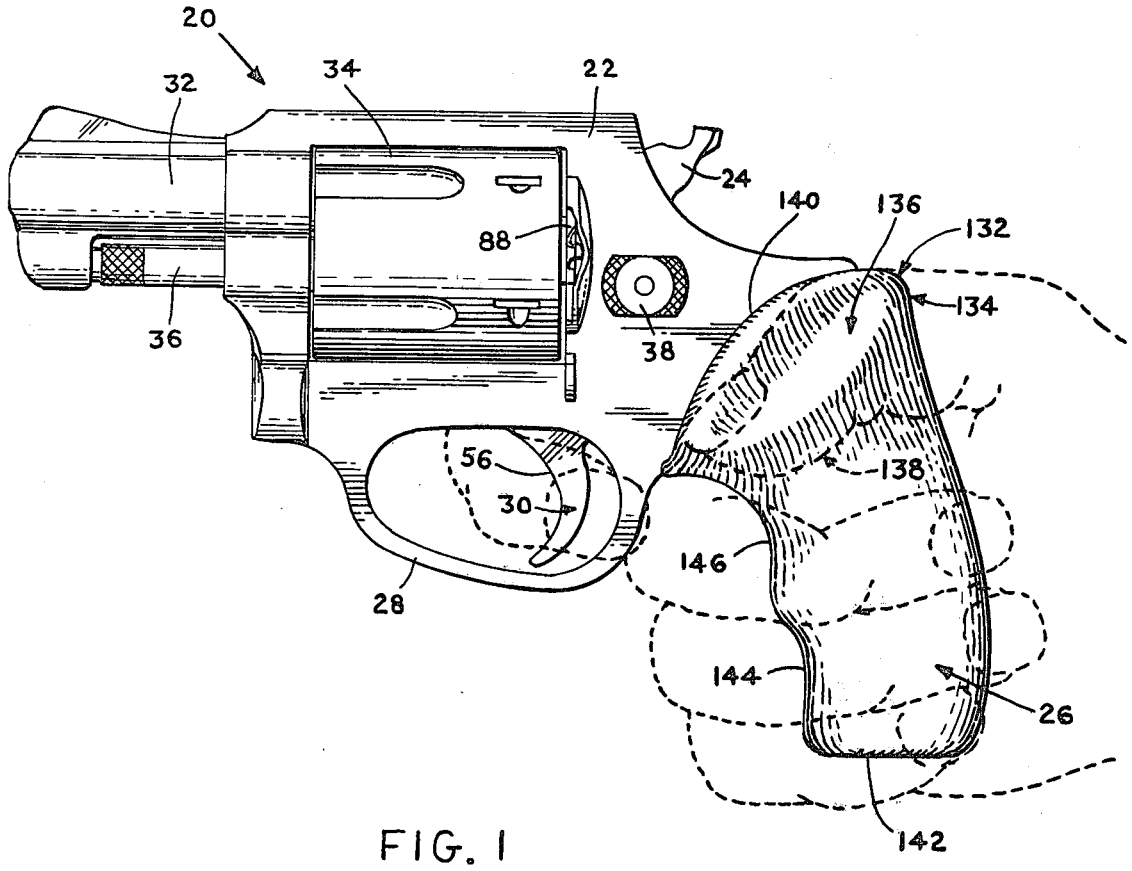

As shown in FIGS. 1 through 5, a revolver-type hand gun, generally indicated at 20, has a frame 22 on which is attached a handle 26 and from which extends a barrel 32. A trigger 30 is disposed within a trigger housing 28 to actuate a cylinder 34 and a hammer 24. The cylinder rotates on an extractor rod 36 as is well known in the revolver-type hand gun manufacturing art. A thumb piece 38 on the left side of the hand gun actuates the bolt to allow the cylinder to pivot out for ejection of cartridges and reloading of the cylinder.

As shown in FIGS. 3, 4, 5 and 8, the hammer, generally indicated at 24, is pivotally mounted on a pivot pin 40 passing through the hammer pivot pin passage 42 in the side of the hammer. The foot 44 of the hammer extends from the bottom of the hammer assembly to coact with the secondary of the trigger assembly to pivot the hammer backward into the cocked position when the trigger is retracted. The force of the trigger primary 62 against the sear 66 and the secondary 64 against the foot 44 of the hammer 24 causes the hammer to rotate about the hammer pivot pin 40 to compress the mainspring 54 which extends about the hammer guide 48 having a hammer guide ball 50 which is engaged within the hammer guide socket 52 is the rear of the hammer.

When the trigger has been displaced or pulled back sufficiently so that the secondary 64 has lost contact with the foot 44 of the hammer 24, the mainspring will force the hammer forward toward the firing pin 112 to percuss the firing pin against the cartridge in the cylinder chamber positioned for discharging the cartridge in that chamber at the twelve o'clock or uppermost point in the cylinder.

Note that the hammer has a striking surface 46 which is stepped down from the hammer safety step 47 so that during the normal rest position of the firearm, as shown in FIG. 1, the safety step will be in contact with the rear of the gun frame 23 and the striking surface 46 of the hammer 24 will not be in contact with the firing pin and cannot in any way cause discharge of the firearm.

Figure 9:
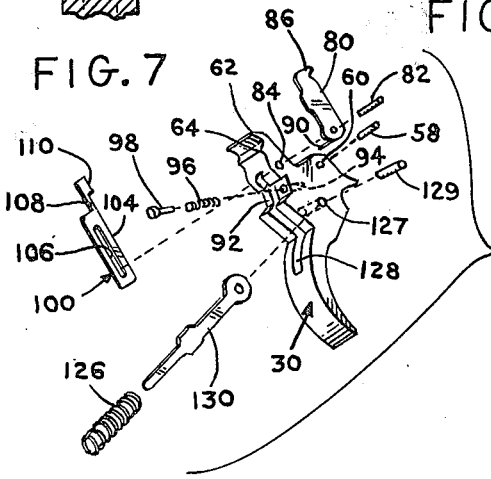
FIG. 9 is an exploded view of the trigger used in the hand gun shown in FIGS. 1–7.

The trigger assembly, generally indicated as 30, and shown in exploded view in FIG. 9, has a finger gripping surface 56 which is normally gripped by the first finger to pivot the entire trigger about a pivot pin 58 mounted in trigger pivot pin passage 60. The entire trigger assembly is pivoted, including the primary 62 and the secondary 64 extending upward and backward from the trigger gripping surface.

Figure 3:
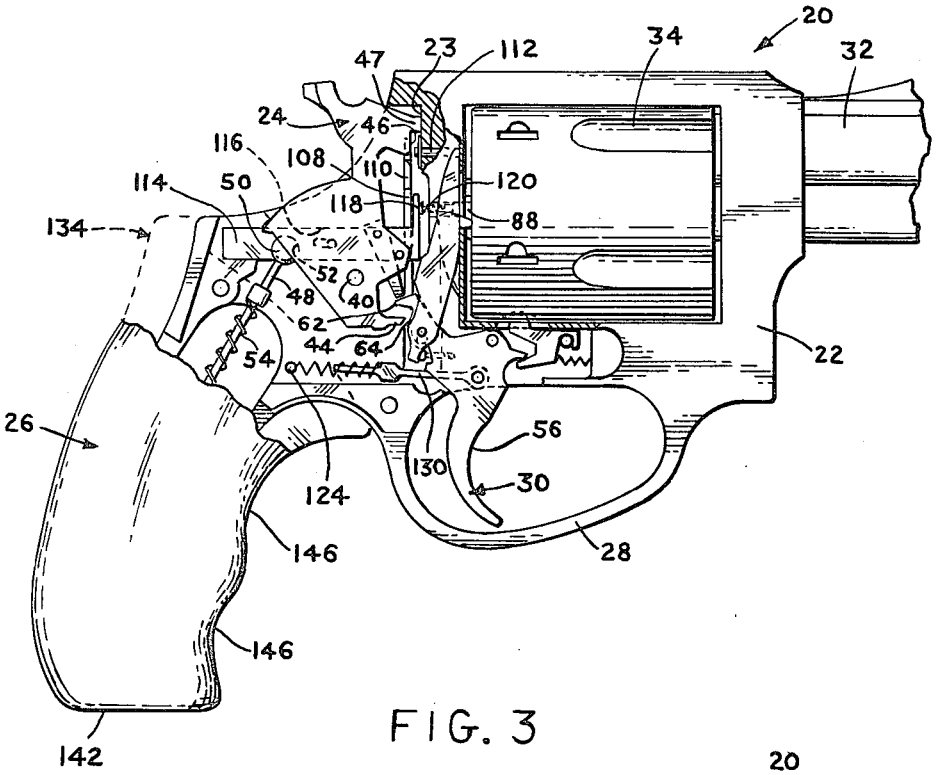
Figure 4:
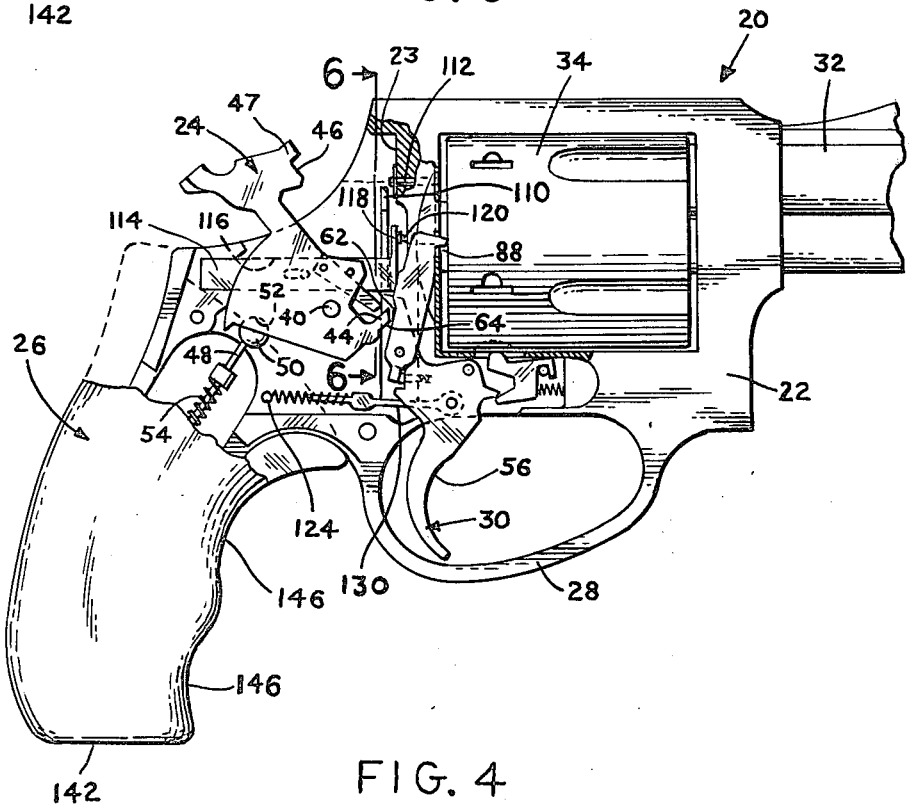

The primary and secondary of the trigger play a critical function in the sequence of coacting parts required to fire the revolver. As shown in FIG. 3, when the gun is at rest, the primary 62 extends above the hammer foot 44 and is just out of contact with the bottom of the sear 66 extending downward from the hammer. As the trigger is pulled back, the primary 62 will push against the bottom of the sear 66, pivoting the hammer counterclockwise around the hammer pivot pin 40.

Continued pulling or displacement of the trigger toward the rear of the trigger housing will cause the hammer to rotate until the primary is no longer in contact with the bottom of the sear and then the secondary 64 will be in contact with the foot 44 of the hammer to continue the counterclockwise rotation of the hammer. When the hammer is in the fully-retracted or cocked position, the foot 44 will be resting against the secondary of the trigger and in this position, the hammer will remain in the cocked position awaiting further backward displacement of the trigger in order to cause the hammer to fall forward under the influence of the mainspring and thereby discharge the firearm.

Figure 5:
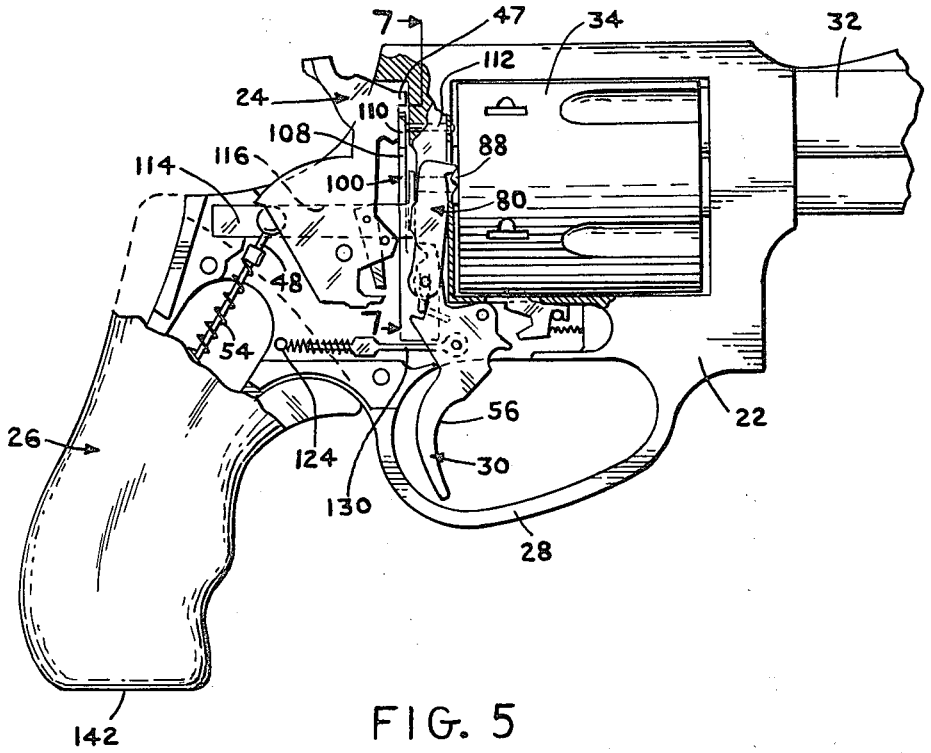
Figure 6:
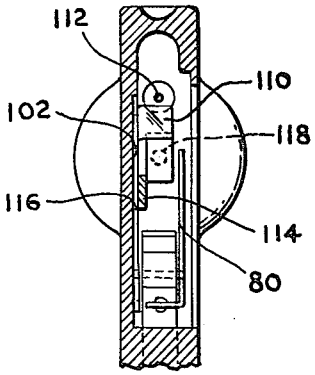
Figure 7:
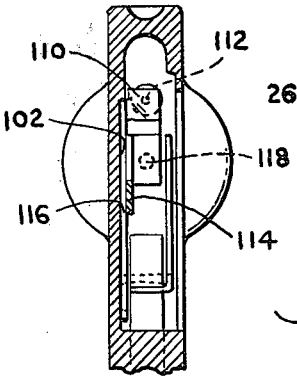
Figure 8:
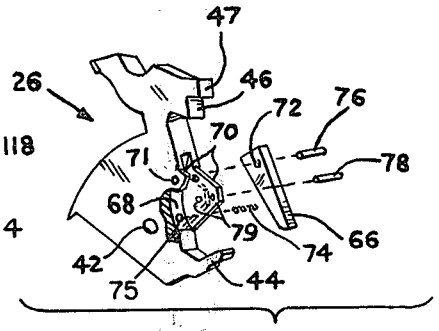
FIG. 8 is an exploded view of the hammer used in the hand gun shown in FIGS. 1–7.

As shown in FIG. 5, after the hammer has fallen forward, the trigger-gripping surface 56 will be in the fully retracted position and, therefore, the trigger rotated to its maximum clockwise rotational position. It will then be necessary for the primary 62 to pass back to its original position below the sear 66 in order for the trigger 30 to return to its rest or extended position. In order to accomplish this, it is necessary for the sear 66 to be resiliently and pivotally mounted within the hammer to allow it to swing out of the way as the primary extends downward when the trigger moves forward.

The mounting of the sear within the hammer assembly has always provided a difficult and intricate task if it is to be done so that the contact between the primary and the sear and then the transition from primary contact with the sear to secondary contact with the foot of the hammer is to be smooth and continuous so as not to require unnecessary pressure or non-uniform pressure on the part of the trigger-gripping surface 56 in order to actuate the firing mechanism through its entire firing cycle. Any such changes in uniformity of pressure or amount of pressure required on the trigger have a critical effect on the aim of the weapon.

In order to properly position the sear in the prior art revolver-type hand guns, it was a common practice for the sear to be pivoted at a single point somewhat near the midpoint of the sear or with enough of an overhang past the pivot point so that the overhang would abut the body of the hammer and limit the travel of the sear. A spring was provided to urge the sear into the rest or extended position, which would be limited by the contact of the overhang with the body of the hammer. Therefore, in order to insure the proper location of the end of the sear, it was necessary to hand match, usually by grinding, the contact between the overhang of the sear above the sear pivot point, with the body of the hammer. It was this contact that positioned the end of the sear very close to the primary so that contact would be made as soon as the trigger was pulled back, while yet not interfering with the positioning of the trigger, and which position would also allow for a smooth transition from contact of the primary with the bottom of the sear to the secondary with the foot of the hammer.

To achieve the proper location and operation of the sear as described above, the present invention provides a sear 66 which is mounted in a sear groove 68 formed in the hammer by two sides 70 which remain after the groove is machined out of the hammer body. The sear is pivotally mounted by means of a pivot pin 76 which passes through a sear pivot pin passage 72 and pivot pin passages 71 in the sides 70 of the sear groove 68.

The forward travel of the sear 66 with relation to the hammer 24 is controlled by a sear stop pin 78 which is mounted across the path of the sear in passages 79 on either side 70 of the sear groove 68. The stop pin therefore effectively limits the travel of the sear and accurately positions it with relation to the foot of the hammer. The sear is urged against the stop pin by means of the sear spring 74 which extends from the sear spring bore 75 in the sear groove 68.

In addition to the contact of the primary and the secondary with the sear and the foot of the hammer during the retraction of the trigger, the trigger assembly performs other important functions in the actuation sequence of the firearm. The hand 80 is pivotally connected to the trigger by means of a hand pin 82 passing through a passage 84 in the trigger. The hand has a pawl 86 at its upper end which is adapted to engage the cylinder ratchet 88 to rotate the cylinder to bring a chamber having an unfired cartridge into proper relationship to the firing pin as the trigger is retracted. The hand 80 is urged constantly against the cylinder ratchet 88 as the trigger pivots around the trigger pivot pin 58 and is always kept in contact with the cylinder ratchet 88 because of the action of a plunger 98 extending from the end of a handspring 96 mounted in the bore 94 of the trigger which bears against the small finger 90 of the hand at the lower end. A hand-finger groove 92 allows the clearance for the hand-finger to swing or pivot about the pivot pin as the trigger is fully retracted, so that the hand will still remain in the vertical position as it is raised, due to the pivoting action of the entire trigger around the trigger pivot pin.

On the opposite face of the trigger, a transfer slide 100 is slidably mounted in a transfer slide groove 102 formed in the side of the frame 22 and is connected to the trigger by means of the hand pin 82 which extends into a slotted groove 106 in the body 104 of the transfer slide 100. The transfer slide has an impact surface 110 which is approximately perpendicular to the body 104 of the transfer slide 100 and is connected to the body by means of a transfer slide stem 108.

The impact surface 110 of the transfer slide is adapted to be sufficiently thick so that when the transfer slide is raised into the firing position by retraction of the trigger, as will be described below, the hammer striking surface will contact the impact surface 110 of the transfer slide to drive it against the firing pin 112 extending through the frame, while being sufficiently thick so that the safety step 47 of the hammer does not contact the rear frame 23 normally struck by the safety stop.

The slotted groove 106 in the transfer slide is a lost motion device which insures that the initial retraction of the trigger will not raise the transfer slide to the firing position; instead, only the last portion of the trigger displacement will cause the transfer slide and, therefore, the impact surface 110 to raise into a position where it can be driven against or percussed against the firing pin by the falling of the hammer.

The transfer slide 100 is held within the transfer slide groove by means of the bolt 114, which rests in a bolt groove 116 and has a bolt face 118 that contacts the bolt pin 120 of the extractor 122 to allow the cylinder to be pivoted to the open position when the thumb piece 38 on the side of the gun is actuated to push the bolt forward.

The trigger tension is controlled not only by the force required to displace the hammer against the force of the mainspring, but also by means of a trigger lever 130 pivotally mounted in the trigger lever slot 128 and held therein by the trigger lever pin 129. The trigger lever extends into the trigger spring 126 which is anchored against a stop 124 extending from the frame 22 of the gun.

Figure 2:
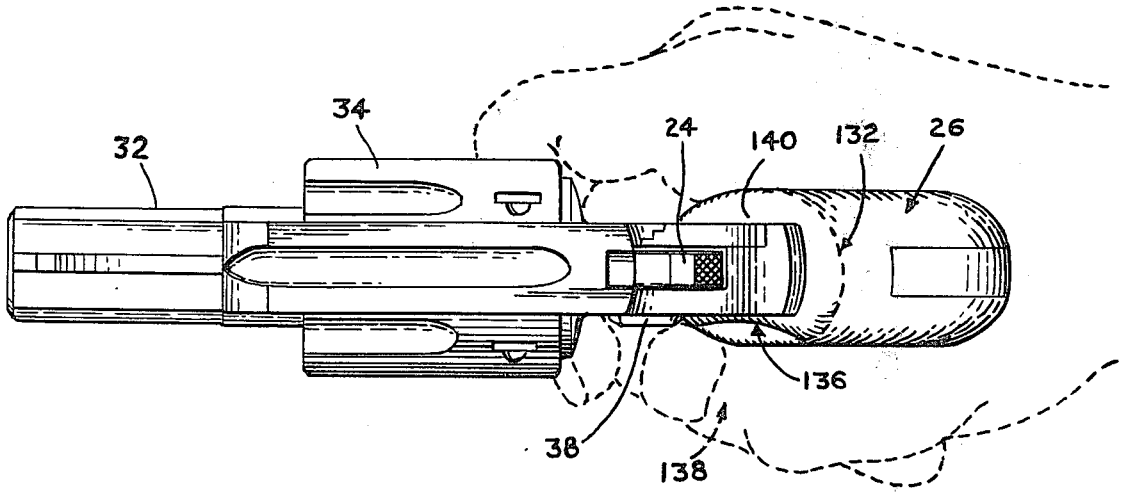

As the trigger is retracted, the projections on the trigger lever against which the end of the trigger spring rests will cause the spring to be compressed against trigger spring stop 124. The compression of the ng produces a uniform tension as the trigger is dis-ed and returns the trigger to its rest position after it eleased by the finger of the person actuating the arm.

s shown in FIGS. 1 and 2, the handle 26 of the arm has a distinctive shape in that the bottom or butt of the handle 142 is relatively narrow in comparison he upper end 140 of the handle from which a wedge tion 134 extends. The handle wedge serves an im-tant function in that it is designed to rest firmly inst the web of the hand between the first finger and thumb when the thumb 138 is positioned in the nb rest groove 136 of the handle, so that the index er of the person using the firearm is resting on the ger gripping surface 56. In that manner, the rear of butt of the handle 142 will be firmly pressed against heal or hypothenar portion of the hand, while the lge 134 at the top 140 of the handle will be firmly sed against the upper part of the web of the thumb (between the thumb and first finger), so that the dle is supported at both its top and its bottom sur-s.

his contact at the top and bottom of the handle vides exceptional stability for the hand gun when perly gripped by the user, as compared to the stan-l "Wild West" six-shooter type of handles normally ciated with revolver-type hand guns. In the "Wild st" type of handle, the top of the handle is relatively ow in comparison with the butt of the weapon and, efore, the major gripping of the weapon occurs at butt of the handle, with very little support provided the upper portion of the hand. Therefore, the ten-cy of the firearm to buck, i.e., for the barrel to twist ard when the gun is discharged, is not effectively ntered by the disposition of the handle in the hand of user. However, in the present invention, as can be from the drawings, the wedge 134 in the back of handle in coaction with the relatively narrow butt tion 142 and the finger grooves 144 and 146, firmly tions the handle in the hand and prevents the gun n twisting or jerking out of the grasp of the user r it has been discharged, so that the gun does not e to be repositioned within the hand of the user prior aking the next shot in order for it to be properly ed again.

should be pointed out that the construction of the d gun described has several distinct advantages. The struction of the sear using a stop pin to locate the its of coaction between the sear and the primary of trigger substantially increases the smoothness of ration of the firing sequence and reduces the neces-for custom grinding or fitting of the sear and the mer with relation to the trigger in order to insure satisfactory operation of the hand gun.

he use of the transfer slide with a lost motion mech-m being driven from the same pin as is used to actu-the hand of the trigger to rotate the cylinder insures the firing pin of the firearm cannot be accidentally cussed in any way whatsoever by the falling of the mer without the trigger being pulled to its maxi-n retracted position, at which point—and only at ch point—will the impact surface of the transfer e be placed in a position where contact between the act surface and the hammer can be achieved. There-, there is no possibility of accidental discharge of weapon and there is no need for hammer blocks or other types of internal safety devices which cannot be adequately checked by the user of the firearm.

Additionally, the trigger construction utilizing the trigger lever in a trigger slot which actuates the trigger spring is a simplified structure in comparison to the rebound slides which have often been used to provide the proper amount of spring tension on the trigger.

Lastly, the distinctive shape of the handle insures that the firearm is always properly and securely grasped by the user to insure that the weapon will not twist out of the user's hand after it is discharged and thereby prevent a rapid and effective refiring of the firearm.

It will be understood that various changes in the details, materials and arrangements of parts which have been herein described and illustrated in order to explain the nature of the invention may be made by those skilled in the art within the principle and scope of the invention, as expressed in the appended claims.

What is claimed is:

1. In a firearm having a frame, a hammer pivotally mounted in said frame, a trigger pivotally mounted in said frame below said hammer and coacting with said hammer to move said hammer from a cocked position to a firing position upon actuation of said trigger, a cartridge-receiving cylinder rotatably mounted in front of the hammer and hand means connected to said trigger and including a hand coacting with said cartridge-receiving cylinder to rotate said cylinder responsive to actuation of said trigger, and a firing pin resiliently extending from said frame, a improved hammer construction comprising:

a sear pivot pin fixed to said hammer;

a sear pivotally mounted on said sear pivot pin to allow one end of said sear to translate toward and away from said cylinder, to coact with said trigger;

sear stop means fixed to said hammer between said sear pivot pin and said translating end of said sear to limit movement of said sear; and resilient means connected to said hammer to urge said translating end of said sear towards said cylinder until stopped by said sear stop means to resiliently position said translating end of said sear.

2. The firearm according to claim 1, wherein said improved hammer construction further comprises:

a sear groove formed in said hammer;

said sear groove having sear groove sides on each side of said sear groove; and said sear pivot pin extending to each of said sear groove sides.

3. The firearm according to claim 2, wherein said sear is dimensioned with relation to said sear groove so that there is clearance between said sear groove and the end of said sear remote from said translating end of said sear.

4. The firearm according to claim 3, wherein said sear stop means comprise a sear stop pin extending to each of said sear groove sides.

5. The firearm according to claim 4, wherein said resilient means urging said translating end of said sear towards said cylinder comprise:

a bore in said sear groove; and spring means extending from said bore to bear against said sear.

6. In a firearm having a frame, a hammer pivotally mounted in said frame, a trigger pivotally mounted in said frame below said hammer and coacting with said hammer to move said hammer from a cocked position to a firing position upon actuation of said trigger, a cartridge-receiving cylinder rotatably mounted in front of the hammer and hand means connected to said trigger and including a hand coacting with said cartridge-receiving cylinder to rotate said cylinder responsive to actuation of said trigger, and a firing pin resiliently extending from said frame, the improvement of apparatus for percussing said firing pin, comprising:

a transfer slide having a body and a striking surface disposed in slidable relation to said firing pin;

means to hold said transfer slide in said slidable relation to said firing pin;

means to slide said transfer slide with relation to said firing pin from a first position to a second position and back to said first position, said first position in which said striking surface is disposed below said firing pin, and said second position wherein said striking surface covers said firing pin, so that striking of said transfer slide striking surface by said hammer will cause said striking surface to percuss said firing pin;

said means to hold said transfer slide in said slidable relation comprise:

a transfer slide groove formed in said slide of said frame to guide movement of said transfer slide; and a bolt disposed on said side of said frame extending over said transfer slide groove.

7. The firearm according to claim 6, wherein said means to slide said transfer slide with relation to said firing pin comprising:

pin means extending from said trigger; and slot means in the body of said transfer slide adapted to receive said pin means extending from said trigger.

8. The firearm according to claim 7, wherein said slot means in said body of said transfer slide having a length substantially longer than the diameter of said pin extending from said trigger so that initial displacement of said pin extending from said trigger will not produce movement of said transfer slide from said first position.

9. The firearm according to claim 8, further comprising:

a striking surface on said hammer adapted to strike the striking surface of said transfer slide; and a safety step on said hammer above said striking surface on said hammer, said safety step extending less than the thickness of said striking surface of said transfer slide, so that said safety step on said hammer will be spaced from the end of said frame when said hammer striking surface contacts said striking surface of said transfer slide.

10. The firearm according to claim 9, further comprising:

hand pin means pivotally connecting said hand means to said trigger; and said hand pin means extending through said trigger to form said pin means extending from said trigger into the slot in the body of said transfer slide.

11. The firearm according to claim 10 further comprising:

a trigger lever groove in said trigger;

trigger lever means pivotally mounted in said trigger lever groove; and trigger spring means connected to said trigger lever to be compressed upon actuation of said trigger.

12. In a firearm having a barrel, a frame, a hammer pivotally mounted in said frame, a trigger pivotally mounted in said frame below said hammer and coacting with said hammer to move said hammer from a cocked position to a firing position upon actuation of said trigger, a cartridge receiving cylinder rotatbly mounted in front of the hammer and hand means connected to said trigger and including a hand coacting with said cartridge-receiving cylinder to rotate said cyclinder responsive to actuation of said trigger, and a firing pin resiliently extending from said frame, the improvement of a handle to enable stable gripping of said firearm during the discharge thereof, comprising:

a bottom butt surface, dimensioned to extend to and abut the hypothenar eminence area of the palm when the handle is grasped for the purpose of actuating said firearm;

a top surface of said handle;

a thumb groove at the top of one side of said handle, adapted to form a rest surface to position the thumb;

said handle having a back surface of varying slope, said slope always being in a forward direction at all points from the midpoint of said handle to the top surface thereof when said barrel is horizontally disposed with said trigger vertically below said barrel; and a wedge-shaped portion disposed at the top of said handle on the back surface thereof, dimensioned to extend against the upper part of the web of the palm between the thumb and first finger when the thumb is disposed in said thumb groove and the first finger is positioned on the trigger of said firearm, so that when said handle is grasped by the average-shape hand for actuating said firearm, the butt of the handle will be securely abutting the hypothenar eminence of the palm simultaneously with the wedge portion at the top of the handle securely abutting the upper part of the web between the thumb and the first finger of the hand.

13. The firearm according to claim 12, further comprising grooves in the front of said handle adapted to position said middle and ring fingers of the hand when wrapping the fingers of said hand about said handle to grasp the firearm.

14. In a firearm having a frame, a hammer pivotally mounted in said frame, a trigger pivotally mounted in said frame below said hammer and coacting with said hammer to move said hammer from a cocked position to a firing position upon actuation of said trigger, a cartridge-receiving cylinder rotatably mounted in front of the hammer and hand means connected to said trigger and including a hand coacting with said cartridge-receiving cylinder to rotate said cylinder responsive to actuation of said trigger, and a firing pin resiliently extending from said frame, a firearm including:

an improved hammer construction comprising:

a sear pivot pin fixed to said hammer;

a sear pivotally mounted on said sear pivot pin to allow one end of said sear to translate towards and away from said cylinder, to coact with said trigger;

a sear stop pin fixed to said hammer between said sear pivot pin and said translating end of said sear to limit movement of said sear; and resilient means connected to said hammer to urge said translating end of said sear towards said cylinder until stopped by said sear stop means to thereby resiliently position said translating end of said sear;

improved apparatus for percussing said firing pin comprising:

a transfer slide having a body and a striking surface disposed in slidable relation to said firing pin;

means to hold said transfer slide in said slidable relation to said firing pin; and means to slide said transfer slide with relation to said firing pin from a first position to a second position and back to said first position, said first position in which said striking surface is disposed below said firing pin, and said second position wherein said striking surface covers said firing pin, so that striking of said transfer slide striking surface by said hammer will cause said striking surface to percuss said firing pin; and n improved handle to enable stable gripping of said firearm during the discharge thereof, comprising:

a bottom butt surface, dimensioned to extend to and abut the hypothenar eminence area of the palm when the handle is grasped for the purpose of actuating said firearm;

a top surface of said handle;

a thumb groove at the top of one side of said handle, adapted to form a rest surface to position the thumb;

a wedge-shaped portion disposed at the top of said handle on the back surface thereof, dimensioned to extend against the top of the web of the palm between the thumb and first finger when the thumb is disposed in said thumb groove and the first finger is positioned on the trigger of said firearm, so that when said handle is grasped by the average-shape hand for actuating said firearm, the butt of the handle will be securely abutting the hypothenar eminence of the palm simultaneously with the wedge portion at the top of the handle securely abutting the top of the web between the thumb and first finger of the hand.

* * * * *